US008613121B1

(12) United States Patent
White

(10) Patent No.: US 8,613,121 B1
(45) Date of Patent: Dec. 24, 2013

(54) FUNERAL SERVICE APPARATUS

(76) Inventor: Jonathan White, East Lyme, CT (US)

( * ) Notice: Subject to any disclaimer, the term of this patent is extended or adjusted under 35 U.S.C. 154(b) by 200 days.

(21) Appl. No.: 12/956,404

(22) Filed: Nov. 30, 2010

Related U.S. Application Data

(60) Provisional application No. 61/283,395, filed on Dec. 2, 2009.

(51) Int. Cl.
*B25F 1/04* (2006.01)
*B26B 11/00* (2006.01)

(52) U.S. Cl.
USPC ..... 7/119

(58) Field of Classification Search
USPC ..... 7/119, 128, 135, 164; 33/275 R, 760
See application file for complete search history.

(56) References Cited

U.S. PATENT DOCUMENTS

| | | | | |
|---|---|---|---|---|
| 166,099 | A | 7/1875 | Hastings | |
| 3,024,901 | A | 3/1962 | Cerato | |
| 4,122,569 | A | 10/1978 | Hitchcock | |
| 4,363,147 | A | 12/1982 | Deweese | |
| 4,783,867 | A | 11/1988 | Tsao | |
| 6,076,665 | A * | 6/2000 | Chuang | 206/234 |
| 6,223,372 | B1 | 5/2001 | Barber | |
| 6,708,360 | B2 | 3/2004 | Ackeret | |
| 6,913,368 | B2 * | 7/2005 | Leu | 362/119 |
| 6,983,506 | B1 | 1/2006 | Brown | |
| 7,036,174 | B2 | 5/2006 | Painsith | |
| 2001/0034910 | A1 * | 11/2001 | Taggart et al. | 7/119 |
| 2002/0064040 | A1 | 5/2002 | Padden | |
| 2004/0016058 | A1 * | 1/2004 | Gardiner et al. | 7/119 |
| 2007/0056117 | A1 * | 3/2007 | Gardiner et al. | 7/119 |
| 2007/0169365 | A1 | 7/2007 | Lin | |
| 2008/0256816 | A1 | 10/2008 | Cosentino | |
| 2009/0000038 | A1 * | 1/2009 | Padden | 7/128 |

FOREIGN PATENT DOCUMENTS

| | | |
|---|---|---|
| WO | WO 94/02799 | 2/1994 |

* cited by examiner

*Primary Examiner* — David B Thomas
(74) *Attorney, Agent, or Firm* — Steven M. McHulh; TCORS

(57) ABSTRACT

A funeral service apparatus and method for implementing the funeral service apparatus is provided and includes an apparatus body having a hex wrench, a knife blade, a Phillips head screwdriver, a flat head screwdriver, a holy water containment vial, a committal sand containment vial, scissors, a tape measure having a measuring tape, a pen and a flashlight. The hex wrench, knife, Phillips head screwdriver, flat head screwdriver, scissors and measuring tape are rotatably associated with the funeral service apparatus to be configurable between an extended configuration and a stored configuration. Moreover, the holy water containment vial, the committal sand containment vial and the pen are slidably associated with the funeral service apparatus to be configurable between an extended configuration and a stored configuration.

20 Claims, 5 Drawing Sheets

Section Y-Y

Section X-X

FUNERAL SERVICE APPARATUS

RELATED APPLICATIONS

This application claims benefit of priority of U.S. Provisional Patent Application Ser. No. 61/283,395 entitled "Funeral Director's Tool" and filed Dec. 2, 2009, the contents of which are incorporated by reference herein it its entirety.

FIELD OF THE INVENTION

This invention relates generally to a device for use in funeral services and more particularly to device for use by a funeral director which has all of the basic tools required to perform funeral services.

BACKGROUND OF THE INVENTION

Funeral directors have a diverse role in the funeral process and their duties can range from preparing the body of the deceased for burial to the coordination and implementation of the logistics of the funeral, such as conducting services in the funeral home, crematory or at the grave site. Accordingly, a funeral director must be prepared to lock/unlock caskets, open/close urns, dispense committal sand and/or holy water and take measurements of remain containers, as well as other functions. Unfortunately, the tools needed to perform these functions require the funeral director to carry a tool case having each of the separate tools necessary to carry out these tasks.

This is undesirable for several reasons. First, as a funeral director is typically in formal dress and must interact with family and friends of the deceased, carrying a tool case is unsightly and inconvenient. Second, because each of the necessary tools would most likely be separately and loosely contained within the tool case, it is possible that one or more tools may become lost. Third, in the situation where the funeral director does not use a tool case to carry the tools, but rather carries the tools separately in his/her pocket, it is more likely that some or all of the necessary tools may be forgotten.

SUMMARY OF THE INVENTION

A funeral service apparatus is provided and includes an apparatus body having a hex wrench, a knife blade, a screwdriver, a containment vial, scissors, a tape measure having a measuring tape, a pen and a flashlight.

A funeral service apparatus is provided and includes an apparatus body configured to include at least one of a hex wrench, a knife blade, a Phillips head screwdriver, a flat head screwdriver, a holy water containment vial, a committal sand containment vial, scissors, a tape measure having a measuring tape, a pen and a flashlight.

A funeral service apparatus is provided and includes an apparatus body having a hex wrench, a knife blade, a Phillips head screwdriver, a flat head screwdriver, a holy water containment vial, a committal sand containment vial, scissors, a tape measure, a pen and a flashlight. The hex wrench, knife, Phillips head screwdriver, flat head screwdriver and scissors are rotatably associated with the funeral service apparatus to be configurable between an extended configuration and a stored configuration. Moreover, the holy water containment vial, the committal sand containment vial, the pen and the measuring tape are slidably associated with the funeral service apparatus to be configurable between an extended configuration and a stored configuration.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike.

DETAILED DESCRIPTION OF THE INVENTION

As disclosed herein with regards to an exemplary embodiment, the present invention provides a portable funeral service apparatus which includes stowable tools necessary for a funeral director to perform funeral services. It should be appreciated that in accordance with the invention, the funeral service apparatus may be of various sizes and shapes and may be configured with a variety of tools in any number of ways. Accordingly, the funeral service apparatus of the present invention may be configured as desired within the scope of the invention and may be different than as described herein without deviating from the scope of the invention. It should be further appreciated that the funeral service apparatus and it's elements may be constructed from any type of material suitable to the desired end purpose, such as metal, aluminum, plastic, glass, composite materials and/or any combination thereof.

Figure 1A:
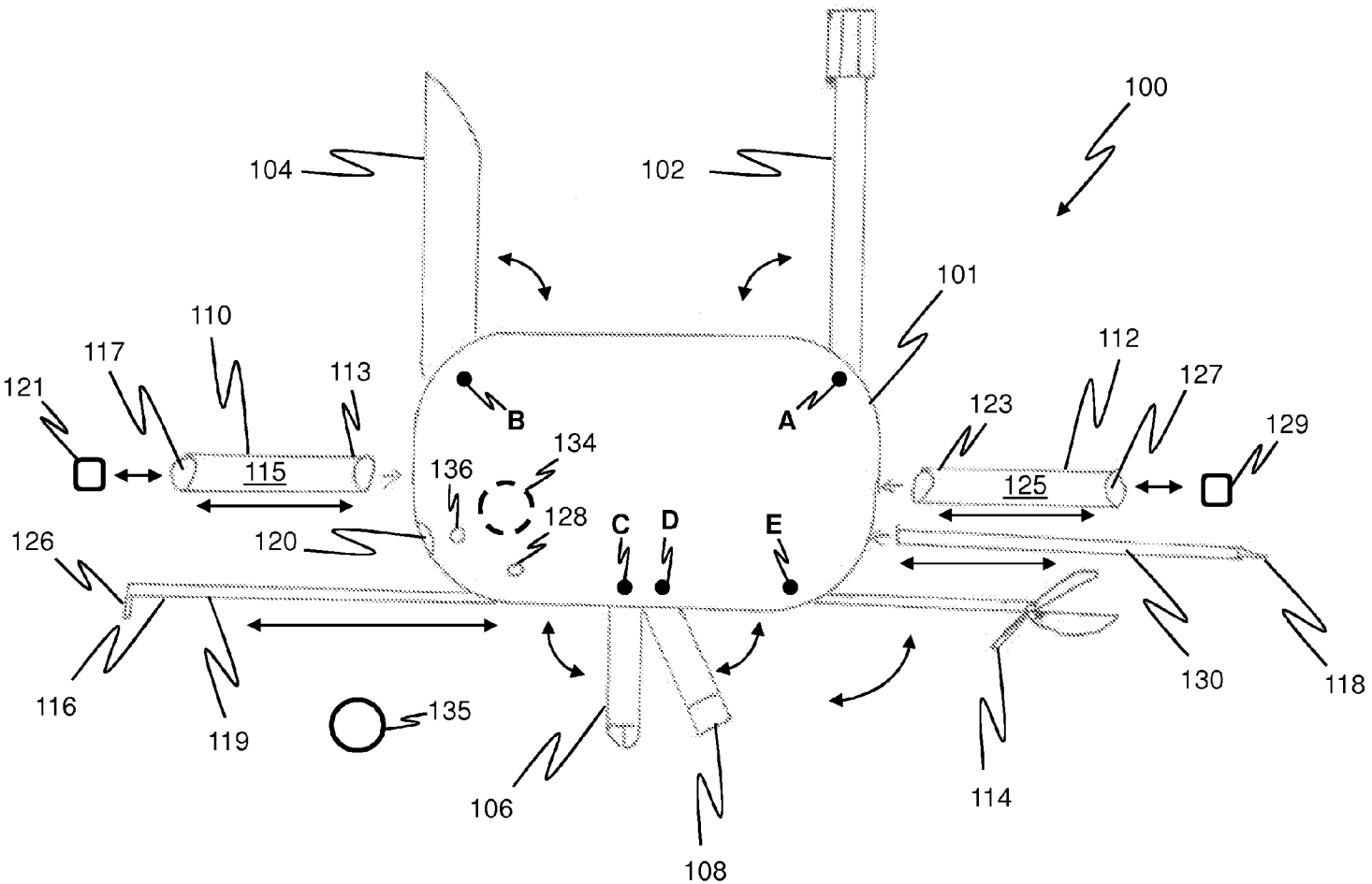
FIG. 1A is a side view of one embodiment of a funeral service apparatus with its elements in an extended configuration, in accordance with the present invention.
Figure 1B:
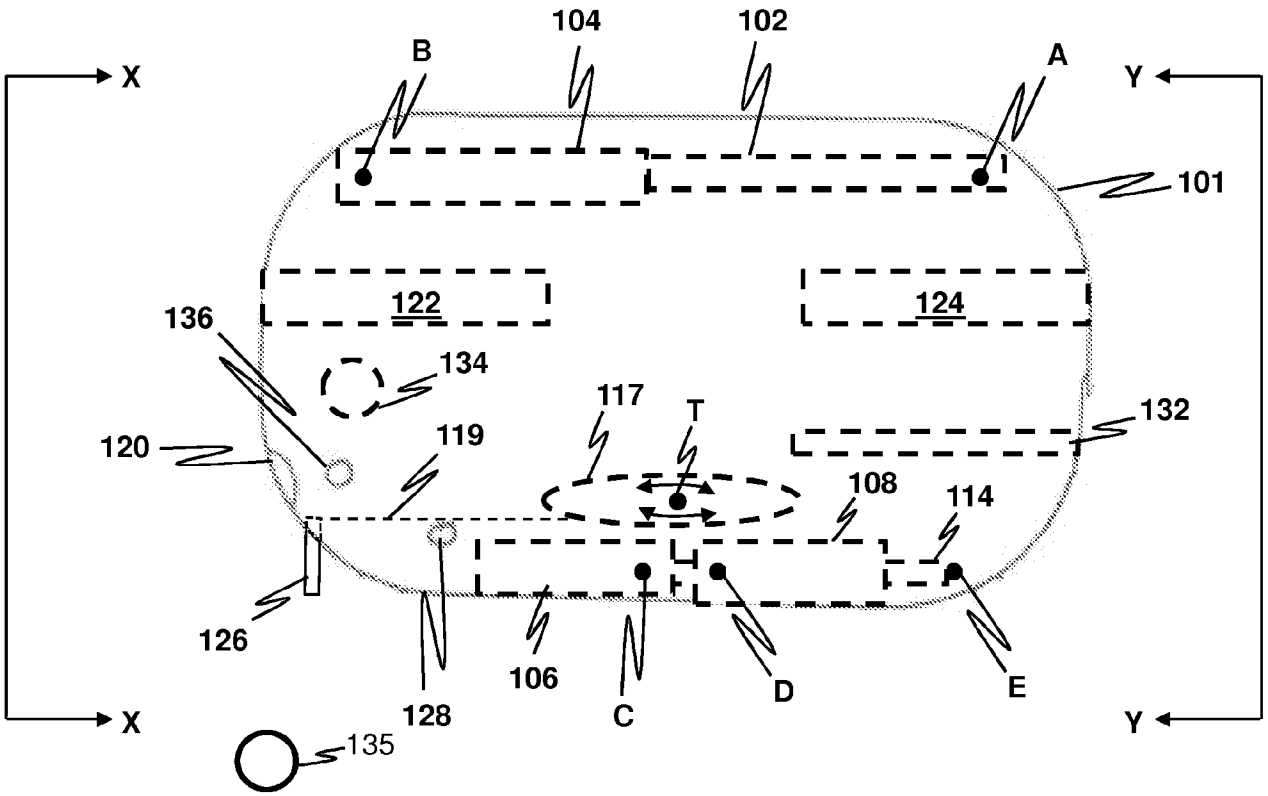
FIG. 1B is a side view of the funeral service apparatus of FIG. 1 with its elements in a stored configuration.
Figure 3:
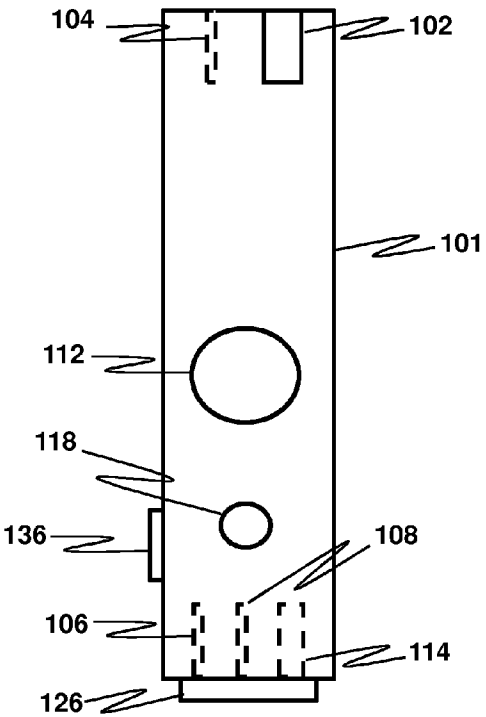
FIG. 3 is an end view showing the opposing end of the funeral service apparatus as shown in FIG. 2.
Figure 2:
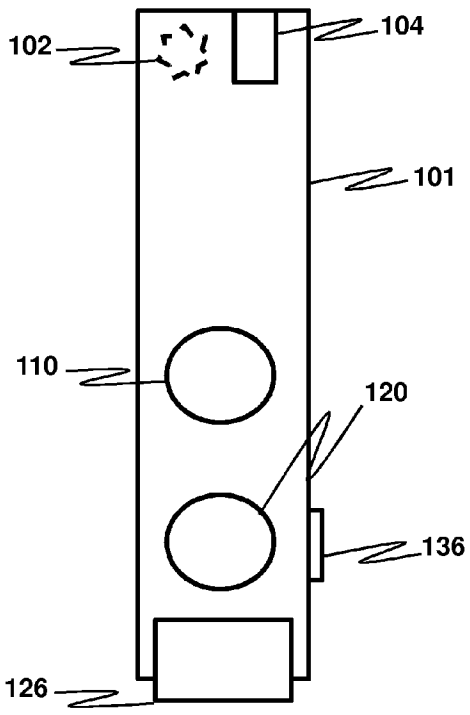
FIG. 2 is an end view of the funeral service apparatus of FIG. 1B.

In accordance with the invention, one embodiment of a funeral service apparatus 100 is provided and is as shown in FIG. 1, FIG. 2 and FIG. 3. As can be seen, the funeral service apparatus 100 includes an apparatus body 101 configured to include at least one of a hex wrench 102, a knife blade 104, a Phillips head screwdriver 106, a flat head screwdriver 108, a holy water containment vial 110, a committal sand containment vial 112, scissors 114, a tape measure 116, a pen 118 and a flashlight 120. In accordance with the invention the tape measure 116 may be of any type and/or size, such as a self-retractable tape measuring device having a measuring tape that is substantially equal (may be more or may be less) to 36 inches in length when extended.

In accordance with the invention, each of the hex wrench 102, knife blade 104, Phillips head screwdriver 106, flat head screwdriver 108 and scissors 114 are configurable between an extended configuration (See FIG. 1A) and a stored configuration (See FIG. 1B). It should be appreciated that certain elements of the funeral service apparatus 100 may be configurable between their extended configurations and their stored configurations by rotating about their respective axes. For example, the hex wrench 102 may be configurable between the extended configuration and the stored configuration by rotating the hex wrench 102 about a hex axis A, the knife blade 104 may be configurable between the extended configuration and the stored configuration by rotating the knife blade 104 about a knife axis B, the Phillips head screwdriver 106 may be configurable between the extended configuration and the stored configuration by rotating the Phillips head screwdriver 106 about a Phillips head axis C, the flat head screwdriver 108 may be configurable between the extended configuration and the stored configuration by rotating the flat head screwdriver 108 about a flat head axis D and the scissors 114 may be configurable between the extended configuration and the stored configuration by rotating the scissors 114 about a scissors axis E.

It should be appreciated that because other arrangements of the elements of the funeral service apparatus 100 are contemplated, that certain rotatable elements may share axes. For example, the Phillips head screwdriver 106 and the flat head screwdriver 108 may be arranged in a side-by-side configuration. In this case, it is conceivable that the Phillips head screwdriver 106 and the flat head screwdriver 108 may share the same axes of rotation.

The holy water containment vial 110 may be associated with the funeral service apparatus 100 by being contained within a holy water containment vial cavity 122 which is sized and shaped to frictionally contain the holy water containment vial 110 within cavity 122. Similarly, the committal sand containment vial 112 may be associated with the funeral service apparatus 100 by being contained within a committal sand containment vial cavity 124 which also is sized and shaped to frictionally contain the committal sand containment vial 112 within cavity 124.

It should be appreciated that the holy water containment vial 110 is configurable between an extended configuration and a stored configuration and includes a vial body 113 that defines a vial cavity 115 having a vial opening 117 communicated with the vial cavity 115. The holy water containment vial 110 also includes a vial cap 121 that is securely associated with the vial body 113 to block the vial opening 117 and thus enclose vial cavity 115. The vial cap 121 may be securely associated with the vial body 113 via any method or device suitable to the desired end purpose, such as a threaded connection, a friction connection, a snap connection and/or a clip connection.

Additionally, the committal sand containment vial 112 is configurable between an extended configuration and a stored configuration and includes a vial body 123 that defines a vial cavity 125 having a vial opening 127 communicated with the vial cavity 125. The committal sand containment vial 112 also includes a vial cap 129 that is securely associated with the vial body 123 to block the vial opening 127 and thus enclose vial cavity 125. The vial cap 129 may be securely associated with the vial body 123 via any method or device suitable to the desired end purpose, such as a threaded connection, a friction connection, a snap connection and/or a clip connection.

The tape measure 116 may include a tape measure rotation device 117 that springingly and resiliently rotates (in a self-retracting manner) about an axis T to wind and unwind a measuring tape 119 having a tape measure end tab 126 into and out of the funeral service apparatus 100. This tape measure end tab 126 includes a lip that is configured to remain external to the funeral service apparatus 100 to keep a portion of the measuring tape 119 located external to the funeral service apparatus 100. Thus, the tape measure end tab 126 acts to prevent the measuring tape 119 from being completely retracted into the funeral service apparatus 100, while also allowing a user to grab the tape measure end tab 126 to extend the tape measure 116 as needed. Additionally, the measuring tape is self-retractable and once extended from the funeral service apparatus 100, the measuring tape 119 may be locked in place via a locking member 128 which prevents the measuring tape 119 from retracting when extended. This locking member 128 may be any type of locking device suitable to the desired end purpose, such as a compression device that interacts with the measuring tape 119 and/or the tape measure rotation device 117 to prevent the measuring tape 119 from moving and/or a locking device that interacts with the tape measure rotation device 117 to keep the tape measure rotation device 117 from rotating.

The pen 118 may have a self contained ink reservoir 130 (that may be replaceable or the pen 118 may be replaceable) and may be frictionally held within a pen cavity 132 (or held via a locking device), where the pen cavity 132 is sized and shaped to frictionally and securingly interact with and contain the pen 118. It should be appreciated that the pen 118 may also be slidably associated with the funeral service apparatus 100 such that the pen 118 cannot be separated from the funeral service apparatus 100 or the pen may be completely separate from the funeral service apparatus 100. Thus, the pen 118 is configurable between an extended configuration and a stored configuration. If the pen 118 is not separatable from the funeral service apparatus 100, the apparatus body 101 may act as the pen body during writing. The flashlight 120 may include an LED (or other acceptable light source) that is integrated with the funeral service apparatus 100, where the light source may be replaceable. Accordingly, the funeral service apparatus 100 may include a light battery compartment 134 and a light switch 136, wherein the light battery compartment 134 include a removable battery compartment cover 135. It should be appreciated that the removable battery compartment cover 135 may be securely associated with the apparatus body 101 via any method or device suitable to the desired end purpose, such as a threaded fit, a friction fit, a snap fit and/or a clip. It should be further appreciated that one or more of the holy water containment vial 110, the committal sand containment vial 112 and the pen 118 may be connected to or may be separate from (although contained within) the funeral service apparatus 100.

Figure 4:
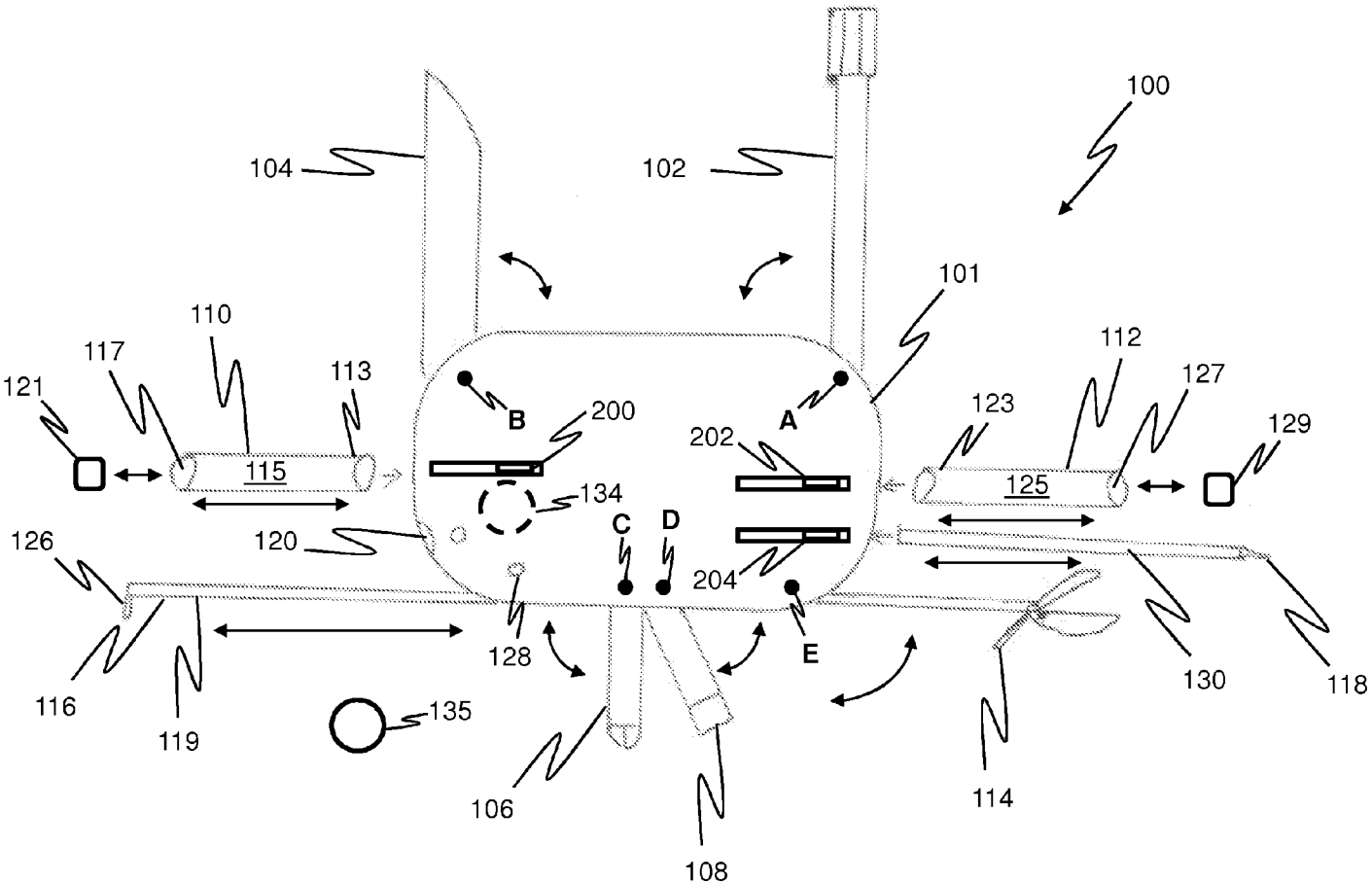
FIG. 4 is a side view of an additional embodiment of a funeral service apparatus with its elements in an extended configuration.

Moreover, at least one of the holy water containment vial 110, the committal sand containment vial 112 and the pen 118 may be frictionally contained (or via a locking device) within the funeral service apparatus 100 and may be removed via a slidable handle device 200, 202, 204 integrated with the funeral service apparatus 100 (see FIG. 4) or via a portion of the at least one holy water containment vial 110, committal sand containment vial 112 and pen 118 (such as the cap) which may or may not protrude from the funeral service apparatus 100. Additionally, although the flashlight 120 disclosed herein is shown as being integrated with the funeral service apparatus 100, it is contemplated that the flashlight 120 may be a separate apparatus that can be contained within the funeral service apparatus 100 (via friction and/or locking device) and removed when desired.

It is also contemplated that although certain elements are described herein as being slidable while other certain element are described herein as being rotatable, the elements of the present invention may be configured in any manner suitable to the desired end purpose. For example, while the hex wrench 102 is described herein as being rotatable, it is contemplated that the hex wrench 102 may be slidable into and out of position and while the pen 118 is described herein as being slidable, it is contemplated that the pen 118 may be slidable into and out of position. Moreover, it is contemplated that the funeral service apparatus 100 may be of various sizes and as such the elements of the funeral service apparatus may be of size suitable to the desired end purpose.

Figure 5:
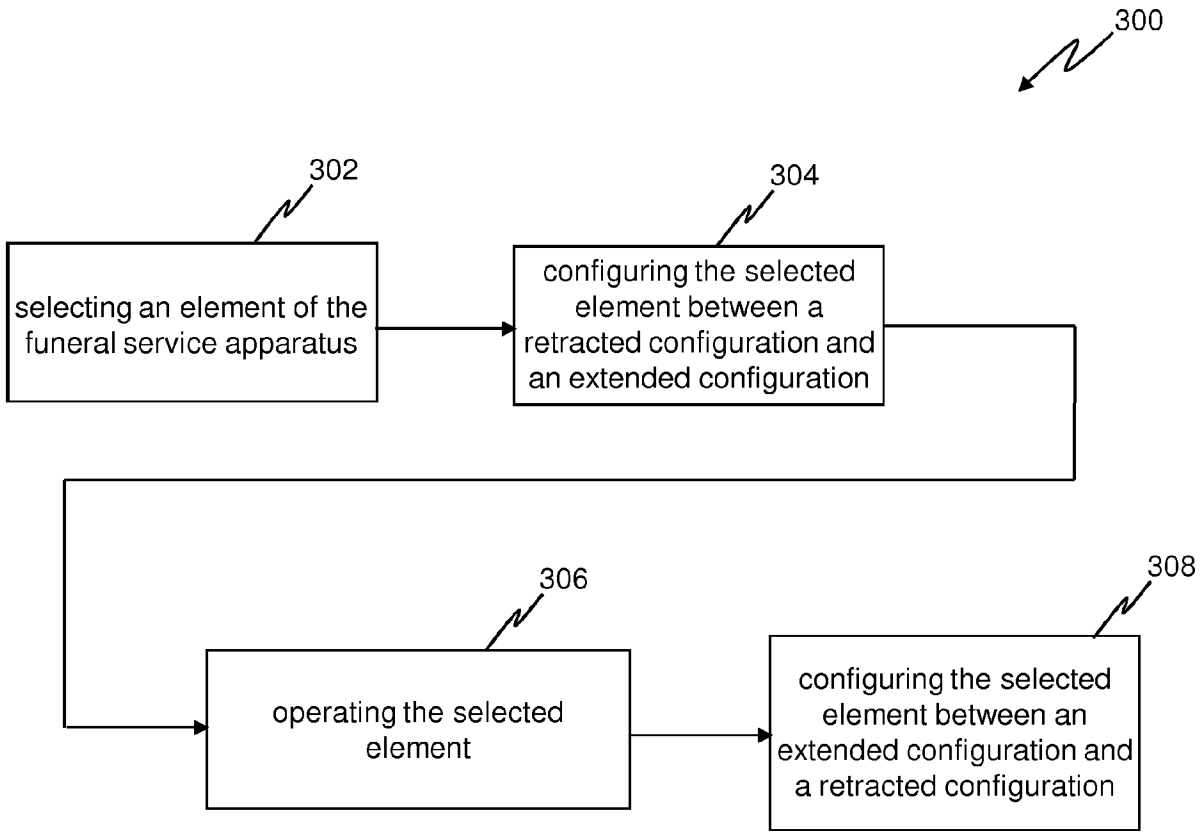
FIG. 5 a block diagram illustrating a method for implementing the funeral service apparatus of FIG. 1.

In accordance with the present invention and as shown in FIG. 5, a block diagram illustrating a method 300 for implementing the funeral service apparatus 100 is shown and includes selecting an element of the funeral service apparatus 100 wherein the element includes at least one of the hex wrench 102, the knife blade 104, the Phillips head screwdriver 106, the flat head screwdriver 108, the holy water containment vial 110, the committal sand containment vial 112, the scissors 114, the tape measure 116, the pen 118 and the flashlight 120, as shown in operational block 302. When the element of the funeral service apparatus 100 is selected, the selected element is then configured from a retracted configuration into an extended configuration, as shown in operational block 304. For example, if the hex wrench 102, the knife blade 104, the Phillips head screwdriver 106, the flat head screwdriver 108 and/or the scissors 114 are selected, then the selected element is rotated from the retracted configuration into the extended configuration. If the holy water containment vial 110, the committal sand containment vial 112 and/or the pen 118 is selected then the selected element is slidably configured from the retracted configuration into the extended configuration. If the tape measure 116 is selected than the measuring tape 119 is pulled out of the funeral service apparatus 100 from the retracted configuration into the extended configuration. The locking member 128 may be engaged to lock the tape measure 116 in place. And if the flashlight 120 is selected then the light switch 136 may be configured to turn on the flashlight 120, where the light switch 136 may be any type of switch suitable to the desired end purpose, such as a compression switch or a toggle switch.

The selected element is then operated as desired, as shown in operational block 306. When the operation of the selected element is complete, the selected element is then configured from an extended configuration into the retracted configuration, as shown in operational block 308. For example, if the hex wrench 102, the knife blade 104, the Phillips head screwdriver 106, the flat head screwdriver 108 and/or the scissors 114 were selected, then the selected element is rotated from the extended configuration into the retracted configuration. If the holy water containment vial 110, the committal sand containment vial 112 and/or the pen 118 was selected then the selected element is slidably configured from the extended configuration into the retracted configuration. If the tape measure 116 was selected than the measuring tape 119 is allowed to retract back into the retracted configuration from the extended configuration. As the tape measure 116 may be locked in its extended via a locking member 128, this may be accomplished by disengaging the locking member 128 to allow the measuring tape 119 to retract. And if the flashlight 120 was selected then the light switch 136 may be configured to turn off the flashlight 120.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A funeral service apparatus, comprising:

an apparatus body, wherein the apparatus body includes a hex wrench, a knife blade, a screwdriver, a containment vial, scissors, a tape measure having a measuring tape, a pen and a flashlight, wherein at least one of the hex wrench, knife, screwdriver, scissors and measuring tape are rotatably associated with the funeral service apparatus.

2. The funeral service apparatus of claim 1, wherein the screwdriver is a Philips head screwdriver.

3. The funeral service apparatus of claim 1, wherein the screwdriver is a flat head screwdriver.

4. The funeral service apparatus of claim 1, wherein the hex wrench, knife blade, screwdriver, scissors and measuring tape are rotatable relative to the apparatus body.

5. The funeral service apparatus of claim 1, wherein the pen and containment vial are slidable relative to the apparatus body.

6. The funeral service apparatus of claim 1, wherein the containment vial is a holy water containment vial and includes a vial cavity for containing holy water.

7. The funeral service apparatus of claim 1, wherein the containment vial is a committal sand containment vial and includes a vial cavity for containing committal sand.

8. The funeral service apparatus of claim 1, wherein the flashlight includes an LED light source.

9. The funeral service apparatus of claim 1, wherein the pen includes a replaceable ink source.

10. A funeral service apparatus, comprising:

an apparatus body configured to include at least one of a hex wrench, a knife blade, a Phillips head screwdriver, a flat head screwdriver, a holy water containment vial, a committal sand containment vial, scissors, a tape measure having a measuring tape, a pen and a flashlight, wherein the hex wrench, knife, Phillips head screwdriver, flat head screwdriver, scissors and measuring tape are rotatably associated with the funeral service apparatus to be configurable between an extended configuration and a stored configuration.

11. The funeral service apparatus of claim 10, wherein the screwdriver is a Philips head screwdriver.

12. The funeral service apparatus of claim 10, wherein the screwdriver is a flat head screwdriver.

13. The funeral service apparatus of claim 10, wherein at least one of the hex wrench, knife blade, screwdriver, scissors and measuring tape are rotatable relative to the apparatus body.

14. The funeral service apparatus of claim 10, wherein at least one of the holy water containment vial, pen and committal sand containment vial are slidable relative to the apparatus body.

15. The funeral service apparatus of claim 10, wherein the holy water containment vial and includes a vial cavity for containing holy water.

16. The funeral service apparatus of claim 10, wherein the committal sand containment vial and includes a vial cavity for containing committal sand.

17. The funeral service apparatus of claim 10, wherein the flashlight includes an LED light source.

18. The funeral service apparatus of claim 10, wherein the pen includes a replaceable ink source.

19. A funeral service apparatus, comprising:

an apparatus body including, a hex wrench, a knife blade, a Phillips head screwdriver, a flat head screwdriver, a holy water containment vial, a committal sand containment vial, scissors, a tape measure having a measuring tape, a pen and a flashlight, wherein the hex wrench, knife, Phillips head screwdriver, flat head screwdriver, scissors and measuring tape are rotatably associated with the funeral service apparatus to be configurable between an extended configuration and a stored configuration, and wherein the holy water containment vial, the committal sand containment vial and the pen are slidably associated with the funeral service apparatus to be configurable between an extended configuration and a stored configuration.

20. The funeral service apparatus of claim 19, wherein the tape measuring includes a tape measure rotation device configured to self-retract and wherein the measuring tape is substantially equal to 36 inches in length.

* * * * *